US005198640A

United States Patent [19]

Yang

[11] Patent Number: 5,198,640

[45] Date of Patent: Mar. 30, 1993

[54] FULLY CLAD ELECTRIC PTC HEATER WITH A FINNED PROTECTIVE CASING

[76] Inventor: Chiung-hsiang Yang, P.O. Box 55-1670, Taipei (10477), Taiwan

[21] Appl. No.: 706,170

[22] Filed: May 28, 1991

[51] Int. Cl.[5] ..... H05B 3/10; H05B 1/02; H01C 7/02; F24H 1/12

[52] U.S. Cl. ..... 219/530; 219/505; 219/540; 219/541; 219/544; 338/22 R; 392/379

[58] Field of Search ..... 219/504, 505, 530, 540, 219/544, 541, 552, 553, 534; 338/22 R; 392/379

[56] References Cited

U.S. PATENT DOCUMENTS

| | | | |
|---|---|---|---|
| 4,037,082 | 7/1977 | Tamada et al. | 219/541 |
| 4,814,584 | 3/1989 | Bohlender et al. | 219/541 X |
| 4,948,953 | 8/1990 | Starck | 219/541 X |
| 4,954,692 | 9/1990 | Shikama et al. | 219/544 X |

FOREIGN PATENT DOCUMENTS

| | | | |
|---|---|---|---|
| 3042420 | 6/1982 | Fed. Rep. of Germany | 219/505 |

*Primary Examiner*—Anthony Bartis

[57] ABSTRACT

A plurality of positive-temperature-coefficient (PTC) semiconductors are longitudinally positioned in an elongated, finned, thermally and electrically conductive hollow casing having a socket at each end. A first plug connector of a power source seals one of the sockets and is electrically connected to the lower conducting surface of each PTC semiconductor through an electrically conductive plate electrically insulated from the casing by an electrically insulative plate. A second plug connector of the source electrically seals the other socket and is electrically the connected to the upper conducting surface of each PTC semiconductor through an upper portion of the electrically conductive casing, thereby providing an electric heater with the PTC semiconductors and plates fully clad by the casing for enhanced safety, increased efficiency, and more stable construction. An electrically conductive plate may be inserted between the upper surface of each PTC semiconductor and an electrically insulative plate in the upper portion of the casing for connecting the second pole connector of the power source.

10 Claims, 4 Drawing Sheets

FULLY CLAD ELECTRIC PTC HEATER WITH A FINNED PROTECTIVE CASING

BACKGROUND OF THE INVENTION

U.S. Pat. No. 4,037,082 to a Positive Temperature Coefficient Semiconductor Heating Device invented by Tamada et al. discloses an arrangement of components for constructing a heating device employing a plurality of positive temperature coefficient semiconductor (PTCS) heating elements as a PTCS heating element, upper and lower insulating plates, a heat emission plate and a case for entirely covering the layers of the PTCS heating element and the upper and lower insulating plates.

However, such a conventional PTC heating device still has the following drawbacks:

1. The PTC heating element sandwiched between the upper insulating plate and the lower insulating plate is encased in between a case and a heat emission plate by fixing screws or rivets through several holes punched in all side edges formed in the case and the emission plate. Whenever the device is operated at a raised temperature, the heat may cause thermal expansion of some elements which are not stably secured with one another to form gap between some electrical or thermal contecting elements, thereby impairing their electrical heating efficiency or shortening their service life.

2. Two metal film electrodes are provided in each PTC heating element, each electrode having a plurality of strips with fork-like configuration which are separated with each other by a predetermined distance T. So, the two opposite electrodes must be precisely made to prevent a short circuit caused therebetween. Any unexpected false connection or short-circuit of the two electrodes may cause electric sparking hazard or fire accident and may lose the heating effect by such a "complex" fork-like electrodes.

3. From the drawings illustrated in Tamada's patent, their terminals are protruded upwardly from the case and each PTC element is held in a square or rectangular socket formed in the case so that it is difficult to arrange a plurality of PTC elements longitudinally in the case. Such a conventional heating device can be modified inferentially to form a plurality of cases in that each case should then be respectively secured on a longitudinal continuous base plate by rivets or screws to increase its installation complexity and cost.

The present inventor has found the drawbacks of such a conventional PTC heating device, and invented the present fully clad PTC heating means.

SUMMARY OF THE INVENTION

The object of the present invention is to provide an electric heater including a plurality of positive-temperature-coefficient (PTC) semiconductor heating elements longitudinally positioned in a longitudinal thermally conductive casing which is also electrically conductive and generally formed as a hollow rectangular column. An electrical conductive plate is held in the casing as packed by an electrical insulating plate positioned in between the casing and the electrical conductive plate. A first pole connector connected to a positive pole of a power source is provided on a right end portion of the casing for electrically connecting the positive pole to the electrical conductive plate and a lower conducting surface of each PTC semiconductor heating element. A second pole connector connected to a negative pole of the power source is provided on a left end portion of the casing for electrically connecting the negative pole to the thermally conductive casing and an upper conducting surface of each PTC semiconductor heating element. A plurality of heat-exchange plates are juxtapositionally fixed on the casing for dissipating heat outwardly exerted by the plurality of PTC heating elements.

Another object of the present invention is to provide an electric heater having a first pole connector electrically connecting the first pole of the power source to a lower electrical conductive plate and the lower conducting surface of each PTC semiconductor heating element and a second pole connector electrically connecting the second pole of the power source to an upper electrical conductive plate and the upper conducting surface of each PTC semiconductor heating element. The two electrical conductive plates and the PTC semiconductor heating elements are positioned in the longitudinal thermally conductive casing packed by an upper and a lower electrical insulating plate in the casing.

Still another object of the present invention is to provide an electric heater with a fully clad protective casing for a tightly internal connection of all elements in construction of the heater for enhancing its safety, stability, and heating efficiency.

DETAILED DESCRIPTION

Figure 1:
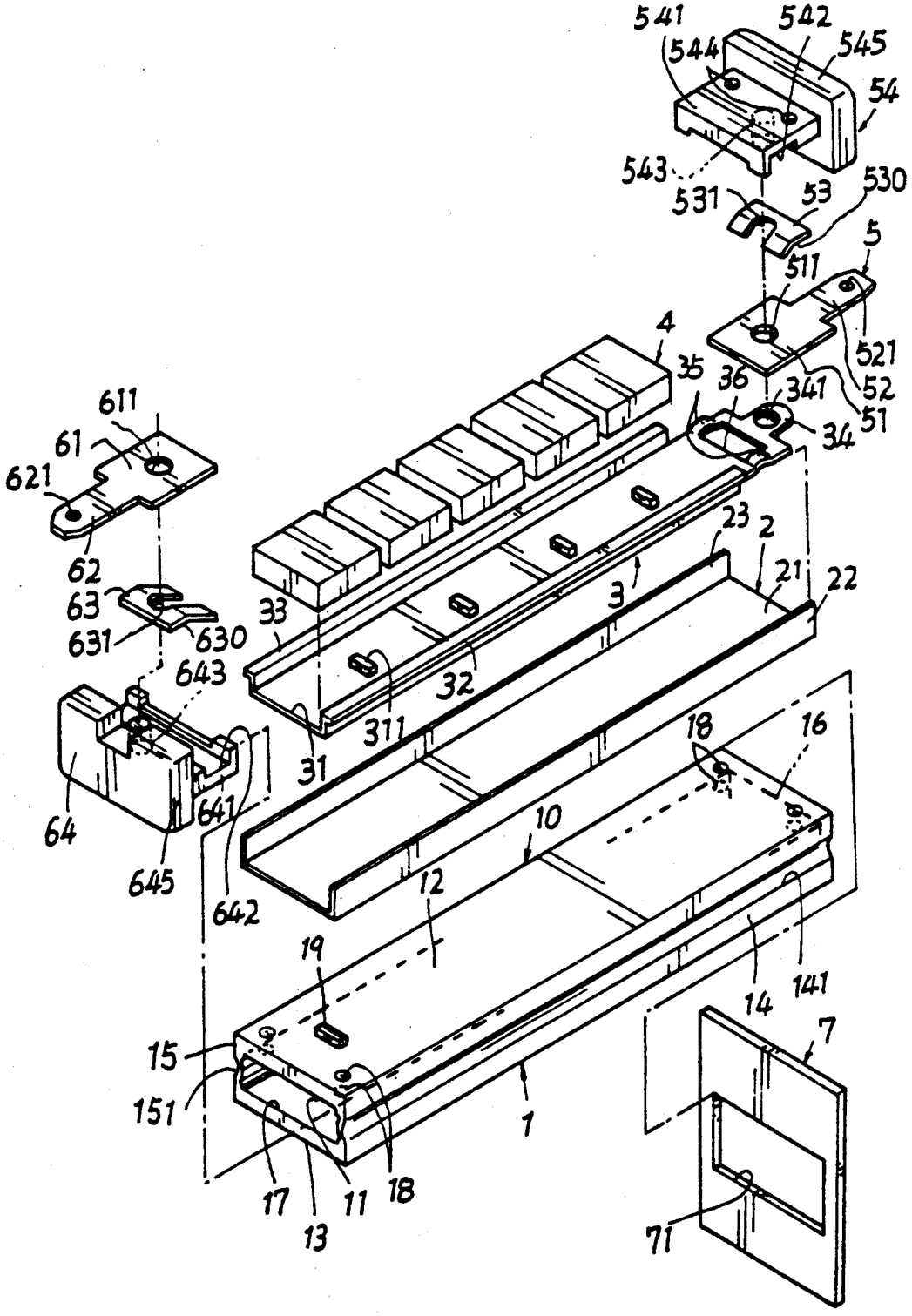
FIG. 1 is an exploded view showing all elements in construction of the present invention.
Figure 2:
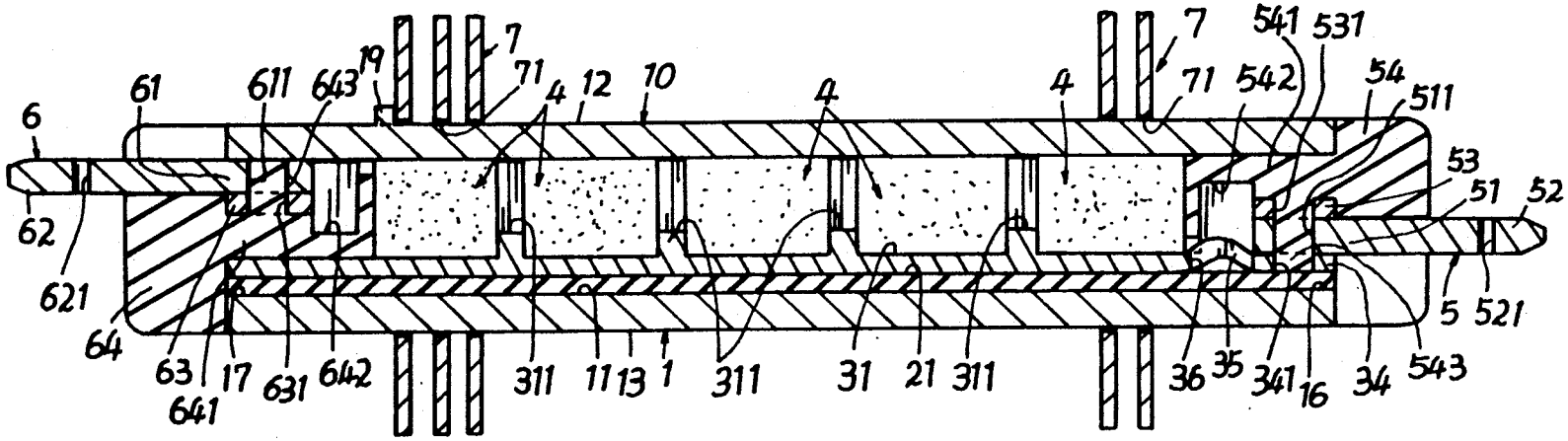
FIG. 2 is a longitudinal sectional drawing of the present invention.
Figure 3:
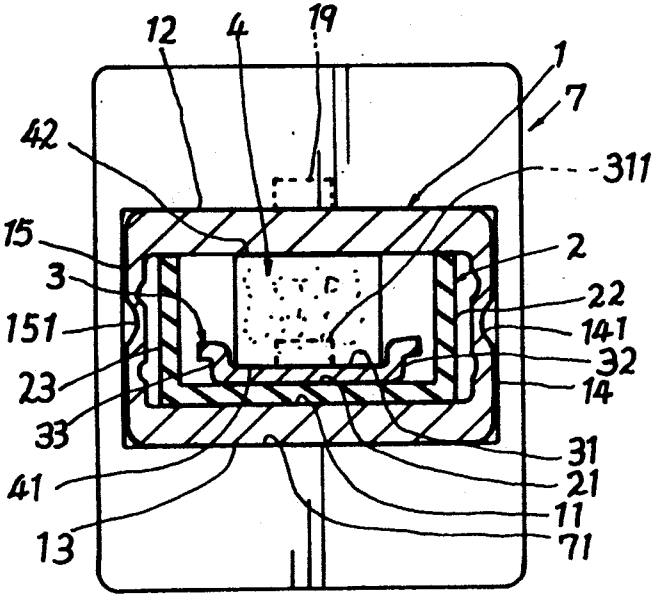
FIG. 3 is a cross sectional drawing of the present invention as viewed from 3—3 direction of FIG. 2.

As shown in FIGS. 1-3, the present invention comprises: a longitudinal thermal and electrical conductive casing 1, an electrical insulating plate 2, an electrical conductive plate 3, a plurality of positive-temperature-coefficient (PTC) semiconductor heating elements 4 made of ceramic semiconductor materials, a first pole connector 5 electrically connectable to a first pole of a power source, a second pole connector 6 electrically connectable to a second pole of the power source, and a plurality of heat-exchange plates or fins 7 juxtapositionally embedded on the casing 1.

The longitudinal thermally and electrically conductive casing 1 defines a generally rectangular cross-section hollow column 10 having an upper longitudinal plate 12 horizontally forming the upper portion of the casing 1, a lower longitudinal plate 13 horizontally forming the lower portion of the casing 2 parallel to the upper longitudinal plate 12, a first side plate 14 and a second side plate 15 respectively vertically formed on two opposite sides of the casing 1, each side plate 14 or 15 being perpendicular to the upper longitudinal plate 12 and defining a rectangular through hole 11 formed through the hollow column 10; a first socket 16 formed in a first end opening of the hollow column 10; a second socket 17 formed in a second end opening of the hollow column 10 opposite to the first socket 16; a plurality of protrusions 18 downwardly protruded from two opposite end portions of the upper longitudinal plate 12 proximate the two sockets 16, 17; and a limiting stopper 19 formed on one end portion of the upper longitudinal plate 12.

Each side plate 14 or 15 is longitudinally formed with a corrugated groove 141 or 151 as shown in FIG. 3 serving as a buffer for absorbing any deformation concentrated to the groove caused by pressing the casing 1 to tightly assemble the heating elements 4, the conductive plate 3, the insulating plate 2 within the casing 1.

The shape of the hollow column 10 may be modified to be a cylindrical column, or any other polygonal shapes, which are not limited in this invention, but is preferably a rectangular column as shown in the figures.

The electrical insulating plate 2 is made of electrical insulative materials with suitable thermal conductivity, for instance, a silicon rubber or a polycarbonate layer having a cross section generally U-shaped; and includes: a longitudinal bottom plate 21 horizontally overlain on an inside surface of the lower longitudinal plate 13, a first and a second side extension 22, 23 longitudinally protruded upwardly from two opposite sides of the longitudinal bottom plate 21 to be retained between the upper and the lower longitudinal plates 12, 13 as shown in FIG. 3.

The electrically conductive plate 3 made of electrical conductive material includes: a longitudinal holding plate 31 horizontally overlain on the bottom plate 21 of the electrically insulating plate 2 having a plurality of partitioning projections 311 transversely formed and equally spaced on the longitudinal holding plate 31 for separately positioning each PTC semiconductor heating element 4 in between two neighbouring projections 311 as shown in FIG. 2; a first side edge portion 32 and a second side edge portion 33 protruded upwardly on two opposite sides of the longitudinal holding plate 31 for transversely confining each heating element within the two side edge portions 32, 33; and an engaging end plate 34 protruded outwardly from the holding plate 31 proximate the first socket 16 of the casing 1 having a stem hole 341 formed in the engaging end plate 34, an arcuate portion 35 arcuately bent on the end plate 34 and a slot 36 cut in a central portion of the arcuate portion 35 of the end plate 34.

Each PTC semiconductor heating element 4 includes a lower conducting surface 41 contacting the electrical conductive plate 3 and an upper conducting surface 42 contacting the upper longitudinal plate 12 of the casing 1 as shown in FIGS. 2, 3.

The first pole connector 5 includes: a first connecting plate 51 having a first central hole 511 formed in the plate 51 and having a first pole pin 52 with a pin hole 521 formed in the pin 52 protruded outwardly from the first connecting plate 51 for connecting a first pole of a power source (not shown), a first terminal plug 54 sealing the first socket 16 of the casing 1, and a spring washer 53 sandwiched between the first connecting plate 51 and the first terminal plug 54 for firmly resiliently holding the first pole connector 5 in the first socket 16 of the casing 1 for a sound electrical connection between the first pole connector 5 and the electrical conductive plate 3.

The spring washer 53 is formed with a bending portion 530 to form a spring and a central washer hole 531 in the washer 53.

The first terminal plug 54 made of electrically insulative materials includes a first plug extension 541 protruding inwardly to be engageable with the first socket 16 of the casing 1, a first inner cavity 542 recessed in the first plug extension 541 for snugly receiving the arcuate portion 35 of the engaging end plate 34 of the electrical conductive plate 3, a first stem 543 protruded downwardly from the first plug extension 541 for engaging a central washer hole 531 of the spring washer 53 and a central hole 511 of the first connecting plate 51 of the first pole connector 5 and a stem hole 341 formed in the engaging end plate 34 of the electrical conductive plate 3 for combinably securing the first terminal plug 54 with the first spring washer and the electrical conductive plate 3, a plurality of recesses 544 in the plug extension 541 engagable with the protrusions 18 formed in the upper longitudinal plate 12 of the casing 1, and a first cap portion 545 secured with the first plug extension 541 sealing the first socket 16 of the casing 1.

The spring washer 53 should be made of materials durable for high temperature without deteriorating its elasticity.

The second pole connector 6 includes: a second connecting plate 61 having a second central hole 611 formed in the plate 61 and having a second pole pin 62 with a pin hole 621 formed in the pin 62 protruded outwardly from the second connecting plate 61 for connecting a second pole of the power source (not shown), a second terminal plug 64 sealing the second socket 17 of the casing 1, and a spring washer 63 sandwiched between the second connecting plate 61 of the connector 6 positioned under the upper plate 12 of the casing 1, and the second terminal plug 64 for firmly resiliently holding the second pole connector 6 in the second socket 17 of the casing 1 for a sound electrical connection between the second pole connector 6 and the upper longitudinal plate 12 of the casing 1.

The spring washer 63 similar to the aforesaid washer 53 is formed with a bending portion 630 to form a spring and a central washer hole 631 in the washer 63.

The second terminal plug 64 made of electrical insulative material includes a second plug extension 641 protruding inwardly to be engageable with the second socket 17 of the casing 1, a second inner cavity 642 recessed in the second plug extension 641 for forming an air space between the second pole connector 6 and the PTC semiconductor heating element 4, a second stem 643 protruded upwardly from the second plug extension 641 for engaging a central washer hole 631 of the second spring washer 63 and a central hole 611 of the second connecting plate 61 of the second pole connector 6 for combinably securing the second terminal plug 64 with the second spring washer 63, and a second cap portion 645 secured with the second plug extension 641 sealing the second socket 17 of the casing 1.

The plurality of PTC semiconductor heating elements 4 are longitudinally disposed on the electrical conductive plate 3 to be separated by the projections 311, and are embedded into the rectangular through hole 11 in the hollow column 10 of the longitudinal thermally conductive casing 1 having the upper conducting surface 42 of each PTC heating element 4 contacted with an inside surface of the upper plate 12 of the casing 1. The electrical insulating plate 2 is sandwiched between the electrical conductive plate 3 and the lower longitudinal plate 13 as shown in FIGS. 3, 2. By slightly pressing the casing 1, the heating elements 4, the conductive plate 3 and the insulating plate 2 can be tightly compressed for ensuring their internal connection. Any deformation caused by the pressing operation will be concentrated at the corrugated grooves 141, 151 formed on either side plate 14, 15 which grooves 141, 151 serve as a buffer for absorbing any depression deformation.

Each heat-exchange plate or fin 7 is formed with a generally rectangular central slot 71 engageable with a cross section of the casing 1 so that each plate 7 is mounted on the casing 1 as limited by the limiting stopper 19 formed on the upper plate 12 of the casing 1. The thermal expansion coefficient of each heat-exchange plate 7 should be smaller than that of said casing 1 so that upon a heating of the casing 1 by the heating elements 4 the casing 1 will be thermally expanded quicker than the plates 7 to firmly tightly secure the plates 7 on the casing 1.

By applying a first or positive pole of a power source to the first pole connector 5 to electrically connect the conductive plate 3 and the lower surfaces 41 of the heating elements 4 and applying a second or negative pole of the power source to the second pole connector 6 to electrically connect the upper plate 12 of casing 1 and the upper surfaces 42 of the heating elements 4, the heating elements 4 will exert heat as directed by current therethrough, which heat is transferred outwardly through the heat-exchange plates 7 mounted on the casing 1.

The present invention is superior to a conventional PTC heating device with the following advantages:

1. All the heating elements 4, the conductive plate 3 and the insulating plate 2 are fully clad in the casing 1 which is sealed by two connectors 5, 6, so that all electrical connecting parts are connected tightly, ensuring a sound electrical connection for increasing a heat efficiency and also for preventing sparking, current leakage or other electrical accidents.

2. The arcuate portion 35 and the slot 36 of the electrical conductive plate 3 reduces heat conducting area to prevent over-heating of the connector 5 for prolonging its service life and increasing an electrical safety.

3. All elements are encased in the casing 1 for preventing moisture or weather attack on the elements of the present invention.

4. It is easier for mass production by reducing production cost since the hollow column 10 can be integrally made such as by extrusion or integral molding process for any desired cutting length.

5. The heat-exchange plate or fin 7 has a thermal expansion coefficient smaller than that of the casing 1 so that the plates 7 can be firmly mounted on the casing 1 when heated by the heating elements 4 for ensuring a firm fixation of the plates 7 on the casing 1.

Figure 4:
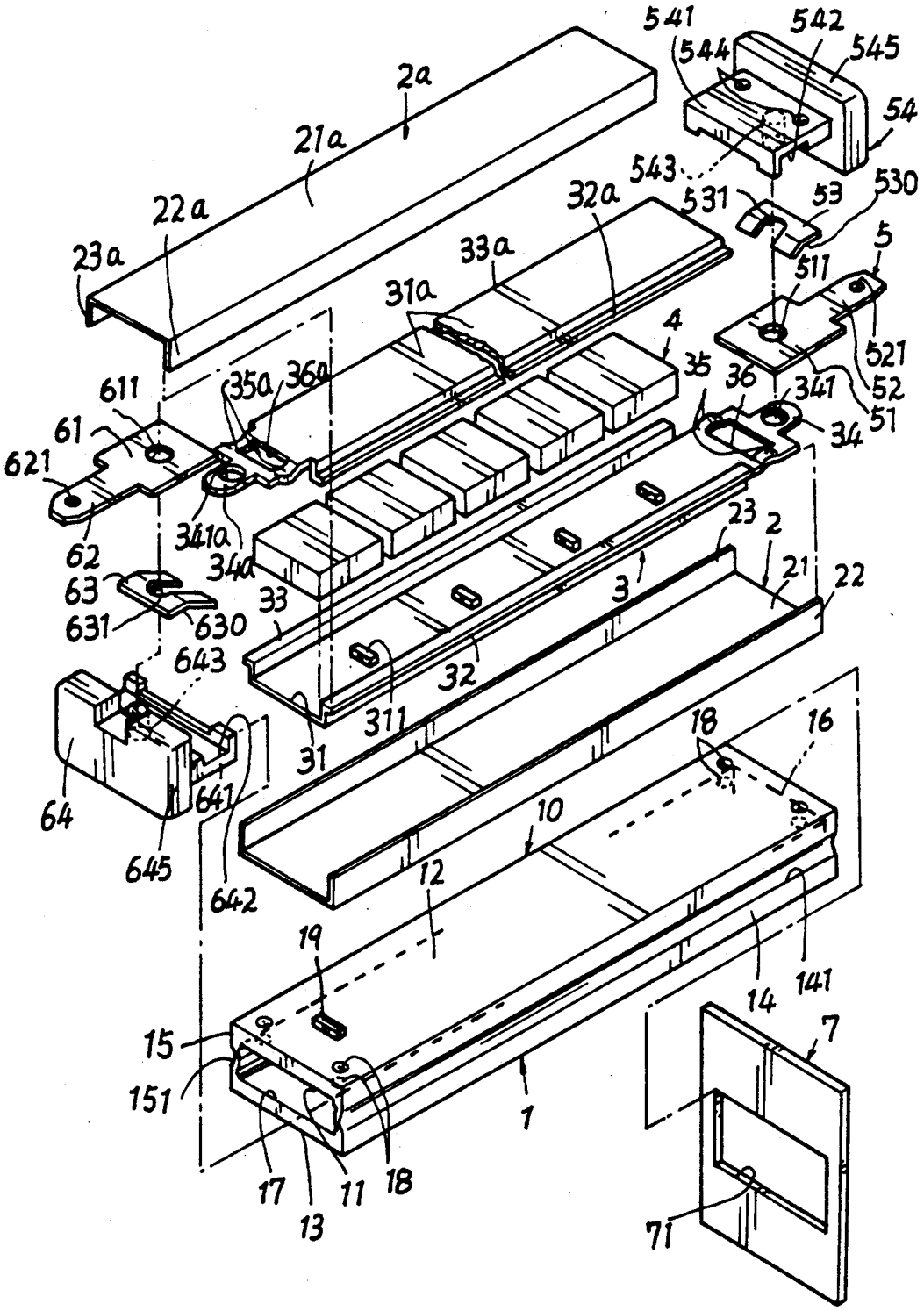
FIG. 4 shows another preferred embodiment of the present invention.
Figure 5:
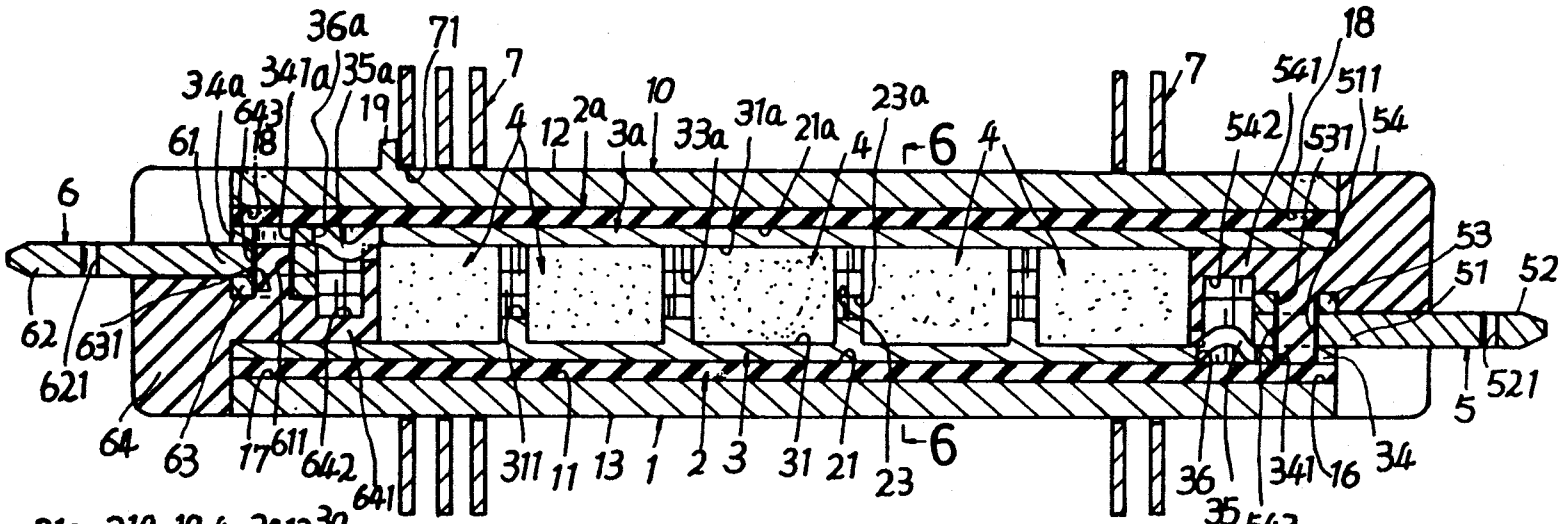
FIG. 5 is a longitudinal sectional drawing of the present invention as shown in FIG. 4.
Figure 6:
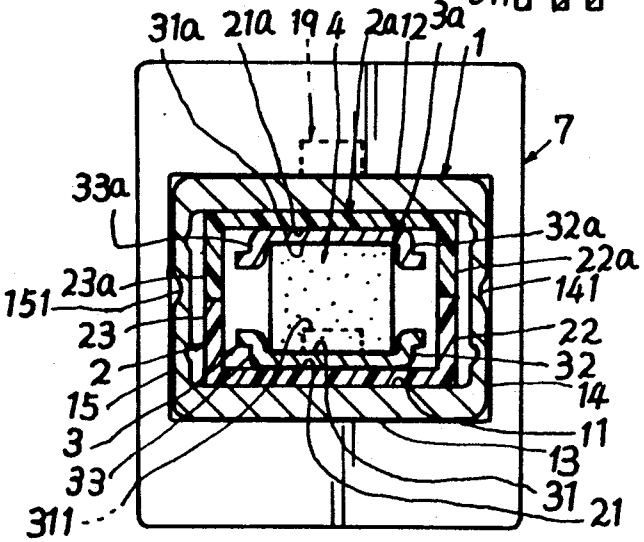
FIG. 6 is a cross sectional drawing of the present invention as viewed from 6—6 direction of FIG. 2.

Another preferred embodiment of the present invention is shown in FIGS. 4–6, in which an upper electrically conductive plate **3*a* is formed on the upper surface 42 of the heating element 4 for electrically connecting the second pole connector 6 and is packed by an upper insulating plate 2*a* sandwiched between the upper conductive plate 3*a* and the upper plate 12 of casing 1. The arcuate portion 35*a* of the upper conductive plate 3*a* is formed adjacent to the second pole connector 6 for reducing thermal conducting area of the end plate 34*a* of the upper conductive plate 3*a* as shown in FIG. 5. The second plug extension 641 defines the second cavity 642 which snugly receives the arcuate portion 35*a* of the upper conductive plate 3*a*. A lower conductive plate 3 and a lower insulating plate 2 are formed on a lower portion inside the casing 1 for positioning each heating element 4 in the casing 1 in cooperation with the upper conductive plate 3*a*, and the upper insulating plate 2*a* especially as shown in FIG. 6**.

I claim:

1. A PTC semiconductor heating means comprising:

an elongated thermally and electrically conductive casing made as a hollow column having upper, lower and side portions, a first socket formed in a first end portion of said casing, a second socket formed in a second end portion of said casing opposite to said first socket, and at least a corrugated groove longitudinally recessed in a side portion of said casing;

an electrically insulating plate overlain on a lower portion of said casing within said casing;

an electrically conductive plate overlain on said electrical insulating plate;

a plurality of positive-temperature-coefficient semiconductor heating elements positioned in said casing, each said semiconductor heating element having a lower conducting surface contacting said electrically conducting plate and having an upper conducting surface contacting an upper portion of said casing;

a first pole connector connectable to a first pole of a power source sealing said first socket of said casing and electrically connected to said electrically conductive plate;

a second pole connector connectable to a second pole of the power source sealing said second socket of said casing and electrically connected to the upper portion of said casing; and a plurality of heat-exchange plates longitudinally juxtapositionally mounted on said casing, thereby forming a PTC semiconductor heating means with all of said heating elements, said conductive plate and said insulating plate fully clad in said casing which is sealed by said first and second pole connectors, and whereby upon a powering of said first and second pole connectors, each said semiconductor heating element is powered to produce heat which is transferred outwardly through said casing and said heat-exchange plates.

2. A PTC semiconductor heating means according to claim 1, wherein said hollow column of said casing is generally hyphenated defining an upper longitudinal plate, a lower longitudinal plate parallel to said upper longitudinal plate, two side plates respectively vertically secured between said two longitudinal plates and formed on two opposite sides of said two longitudinal plates, a rectangular through hole formed longitudinally through said casing, a plurality of protrusions downwardly extended from the two end portions of the upper longitudinal plate for engaging a plurality of recesses formed in said first and second pole connectors, and a limiting stopper formed on one end portion of said upper longitudinal plate for limiting said heat-exchange plate mounted on said casing.

3. A heating means according to claim 2, wherein said electrically insulating plate has a generally U-shaped cross section and includes: a longitudinal bottom plate horizontally overlain on an inside surface of the lower longitudinal plate, a first and a second side extension longitudinally protruded upwardly from two opposite sides of the longitudinal bottom plate to be retained between the upper and the lower longitudinal plates of said casing.

4. A heating according to claim 3, wherein said electrically conductive plate includes: a longitudinal holding plate horizontally overlain on a bottom plate of said electrically insulating plate and having a plurality of partitioning projections transversely formed and equally spaced along the length of said longitudinal holding plate for separately positioning each said semiconductor heating element in between two neighbouring projections on said longitudinal holding plate; a first side edge portion and a second side edge portion protruded upwardly on two opposite sides of the longitudinal holding plate for transversely confining each said heating element within the two side edge portions; and an engaging end plate protruded outwardly from the holding plate proximate the first socket of the casing having a stem hole formed in the engaging end plate to be engageable with a first and second stem formed in said first and second pole connectors, an arcuate portion arcuately bent on the end plate and a slot cut in a central portion of the arcuate portion of the end plate.

5. A heating means according to claim 1, wherein said first pole connector includes: a first connecting plate having a first pole pin protruded outwardly of said casing first end portion from the first connecting plate for connecting a first pole of a power source, a first terminal plug sealing the first socket of the casing, and a spring washer sandwiched between the first connecting plate and the first terminal plug for firmly resiliently holding the first connecting plate in the first socket of the casing for a sound electrical connection between the first pole connector and the electrical conductive plate.

6. A heating means according to claim 5, wherein said first terminal plug made of electrically insulative material includes a first plug extension protruding inwardly to be engageable with the first socket of the casing, a first inner cavity recessed in the first plug extension for snugly receiving an arcuate portion of the engaging end plate of the electrically conductive plate, a first stem protruded downwardly from the first plug extension for engaging a central washer hole of the spring washer and a central hole of the first connecting plate of the first pole connector and a stem hole formed in an engaging end plate of the electrically conductive plate for combinably securing the first terminal plug with the spring washer and the electrically conductive plate, a plurality of recesses in the plug extension engageable with a plurality of protrusions formed in an upper longitudinal plate of the casing, and a first cap portion integral with the first plug extension sealing the first socket of the casing.

7. A heating means according to claim 1, wherein said second pole connector includes: a second connecting plate having a second pole pin protruded outwardly of said casing from the second connecting plate for connecting a second pole of the power source, a second terminal plug sealing the second socket of the casing, and a spring washer sandwiched between the second pole pin and the second terminal plug for firmly resiliently holding the second connecting plate in the second socket of the casing for a sound electrical connection between the second connecting plate and the upper longitudinal plate of the casing.

8. A heating means according to claim 7, wherein said second terminal plug made of electrical insulative material includes a second plug extension protruding inwardly in engagement with the second socket of the casing, a second inner cavity recessed in the second plug extension forming an air space between the second pole connector and the adjacent semiconductor heating element, a second stem protruded upwardly from the second plug extension engaging a central washer hole of the spring washer and a central hole of the second connecting plate of the second pole connector and combinably securing the second terminal plug with the spring washer and second connecting plate, and a second cap portion integral with the second plug extension sealing the second socket of the casing.

9. A heating means according to claim 1, wherein each said heat-exchange plate is formed with a central slot engageable with a cross section of the casing so that each plate is mounted on the casing as limited by a limiting stopper formed on the casing, the thermal expansion coefficient of each said heat-exchange plate being smaller than that of said casing so that upon a heating of the casing by the heating elements the casing will be thermally expanded more quickly than the heat-exchange plates to firmly tightly secure the heat-exchange plates on the casing.

10. A PTC semiconductor heating means comprising:

an elongated thermally and electrically conductive casing made as a hollow column having a first socket formed in a first end portion of said casing, and a second socket formed in a second end portion of said casing opposite to said first socket;

an upper and a lower electrical insulating plate respectively formed in said casing; on an upper portion and a lower portion of said casing;

an upper and a lower electrically conductive plate respectively retained on said two electrical insulating plates;

a plurality of positive-temperature-coefficient semiconductor heating elements positioned in said casing and retained between said two electrically conductive plates, each said semiconductor heating element having a lower electrically conducting surface contacting said lower electrically conductive plate and having an upper conducting surface contacting the upper electrically conductive plate;

a first pole connector connectable to a first pole of a power source sealing said first socket of said casing and electrically connected to said lower electrically conducting plate;

a second pole connector connectable to a second pole of the power source sealing said second socket of said casing and electrically connected to said upper electrically conductive plate; and a plurality of heat-exchange plates longitudinally juxtapositionally mounted on said casing, whereby upon a powering of said first and second pole connectors, each said semiconductor heating element is powered to produce heat transferred outwardly through said casing and said heat-exchange plates.

* * * * *